US006722979B2

(12) United States Patent
Gilmore et al.

(10) Patent No.: US 6,722,979 B2
(45) **Date of Patent: *Apr. 20, 2004**

(54) HYBRID SLOT MACHINE

(75) Inventors: Jason C. Gilmore, Bartlett, IL (US); Larry J. Pacey, Prospect Heights, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/294,410

(22) Filed: Nov. 14, 2002

(65) Prior Publication Data

US 2003/0060271 A1 Mar. 27, 2003

Related U.S. Application Data

(63) Continuation of application No. 09/921,209, filed on Aug. 3, 2001.

(51) Int. Cl.[7] ..... A63F 9/24
(52) U.S. Cl. ..... 463/20; 463/30
(58) Field of Search ..... 463/1, 16, 20–22, 463/25, 30–34, 46–47; 273/138.1, 143 R; 345/173, 607, 629, 905

(56) References Cited

U.S. PATENT DOCUMENTS

| | | | | |
|---|---|---|---|---|
| 4,440,457 | A | 4/1984 | Fogelman et al. | 463/46 |
| 4,517,558 | A | 5/1985 | Davids | 340/700 |
| 6,117,009 | A | 9/2000 | Yoseloff | 463/20 |
| 6,135,884 | A | 10/2000 | Hedrick et al. | 463/20 |
| 6,335,722 | B1 | 1/2002 | Tani et al. | 345/173 |
| 6,533,273 | B2 * | 3/2003 | Cole et al. | 273/138.1 |

FOREIGN PATENT DOCUMENTS

| | | | |
|---|---|---|---|
| EP | 0789338 A1 | 8/1997 | G07F/17/32 |

OTHER PUBLICATIONS

Article for "The Pink Panther", *Strictly Slots*, p. 50, Feb., 2001.
Article for "Flip Flop", *Strictly Slots*, p. 48, Jun., 2000.

* cited by examiner

*Primary Examiner*—Kim Nguyen

(57) ABSTRACT

A hybrid slot machine, controlled by a processor in response to a wager, comprises a video display and a generally flat panel mounted over the video display. The video display is operable to depict a plurality of symbol-bearing reels that are rotated and stopped to place symbols on the reels in visual association with at least one pay line. The flat panel forms one or more transmissive reel windows overlying and revealing the respective reels shown on the video display.

10 Claims, 6 Drawing Sheets

HYBRID SLOT MACHINE

REFERENCE TO RELATED APPLICATIONS

This application is a continuation of U.S. patent application Ser. No. 09/921,209, filed Aug. 3, 2001.

FIELD OF THE INVENTION

The present invention relates generally to gaming machines and, more particularly, to a video-based slot machine designed to appeal to players of mechanical slot machines.

BACKGROUND OF THE INVENTION

Slot machines generally include a plurality of symbol-bearing reels that are rotated and stopped to place symbols on the reels in visual association with one or more pay lines. If a combination of symbols along an active pay line represents a winning combination, the player is awarded a payout identified on a pay table for that winning combination. Slot machines are generally available in two different types. First, a video-based slot machine depicts the symbol-bearing reels on a video display. The number of simulated reels is typically five and the number of pay lines is typically at least five. Second, a mechanical slot machine includes mechanical (physical) slot reels driven by stepper motors. The number of mechanical reels is typically three and the number of pay lines is typically five or less.

Video-based slot machines and mechanical slot machines generally appeal to different segments of the market. Although many players are attracted to the complex and entertaining graphical images, animations, and play sequences afforded by video-based slot machines, many traditionalists are still drawn to mechanical slot machines because they are simplistic machines that often only pay on a single pay line and only require a pull of a handle to initiate a spin of the reels. If a player pulls the handle of a mechanical slot machine and the reels stop with a winning combination of symbols along the pay line, the player is awarded a payout.

It would beneficial to increase the popularity of video-based slot machines because of the advantages provided by such machines. Video-based slot machines allow for flexibility in game design and multi-denominational play and do not require any additional hardware for implementing bonus games. With respect to flexibility in game design, the video display of a video-based slot machine can depict complex and entertaining graphical images, animations, and play sequences that cannot be employed in mechanical slot machines. With respect to flexibility in multi-denominational play, the game (e.g., reel symbol distribution and pay table) can easily be modified to vary the theoretical payback percentage in response to a player's selection of different coin denominations for game play. Such game modifications are not easily made to mechanical slot machines. Further, video-based slot machines do not require any additional hardware for implementing bonus games because the bonus game may be depicted on the primary video display and executed by the same game controller used to execute the video slot game. Mechanical slot machines, on the other hand, require such additional hardware as a secondary video display to implement bonus games.

To increase the popularity of video-based slot machines, efforts have been made to promote such machines at gaming establishments and in print advertising mediums. Despite such efforts, many traditionalists remain loyal to mechanical slot machines and generally avoid video-based slot machines. In order to draw such traditionalists to video-based slot machines, a need exists for a hybrid slot machine that would appeal to players of mechanical slot machines and act as a steppingstone from mechanical to video-based slot machines.

SUMMARY OF THE INVENTION

A hybrid slot machine, controlled by a processor in response to a wager, comprises a video display and a generally flat panel mounted over the video display. The video display is operable to depict a plurality of symbol-bearing reels that are rotated and stopped to place symbols on the reels in visual association with at least one pay line. The flat panel forms one or more transmissive reel windows overlying and revealing the respective reels shown on the video display.

BRIEF DESCRIPTION OF THE DRAWINGS

The foregoing and other advantages of the invention will become apparent upon reading the following detailed description and upon reference to the drawings in which.

Figure 1:
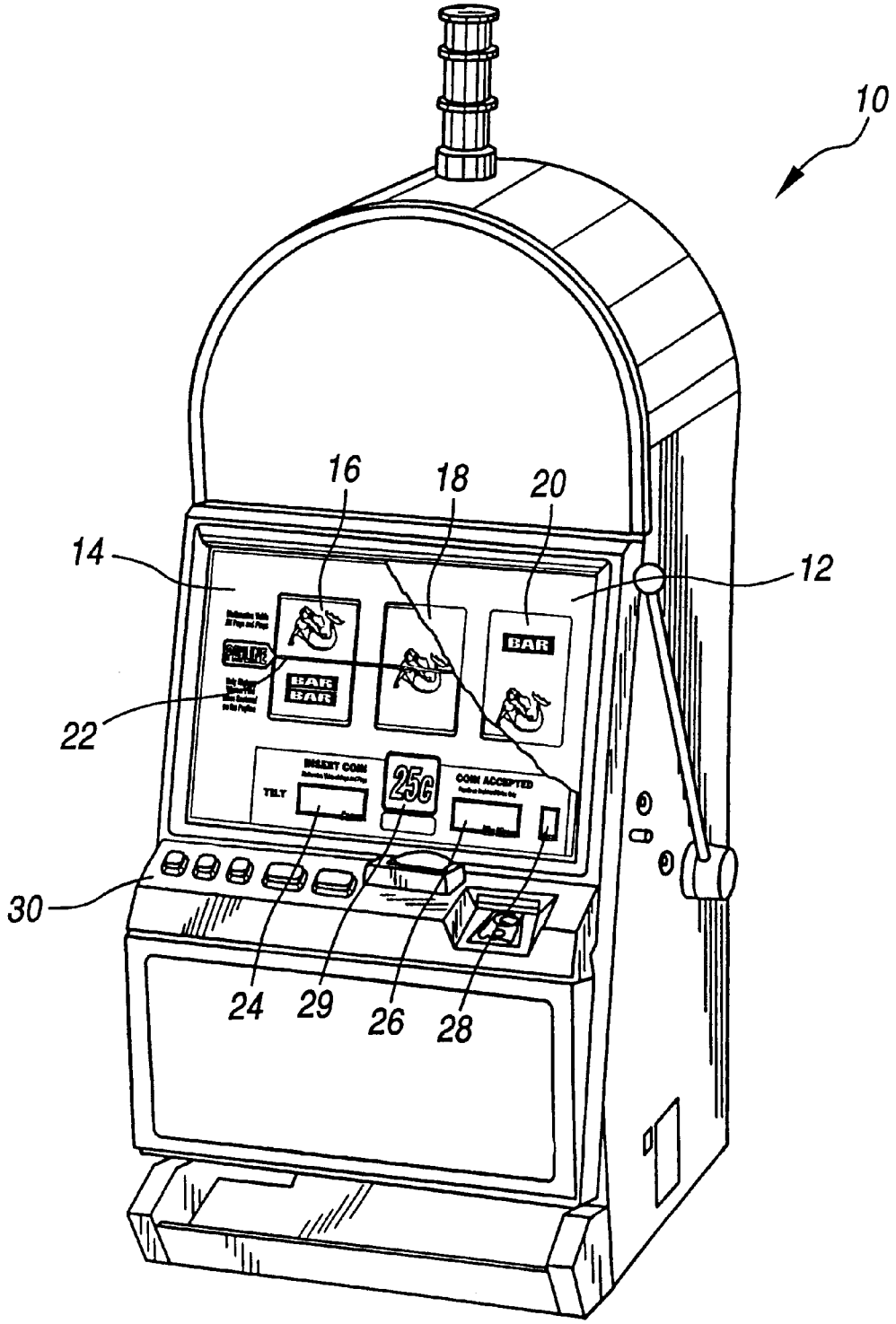
FIG. 1 is a perspective view of a hybrid slot machine embodying the present invention with a portion of a flat panel broken away to reveal a video display.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Figure 2:
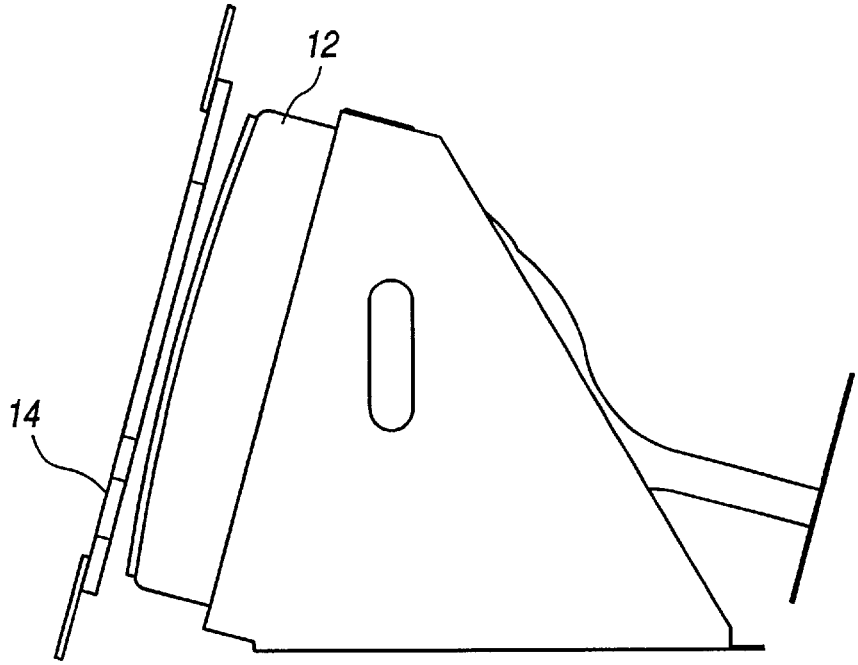
FIG. 2 is a side view of the hybrid slot machine with a portion broken away to reveal the relationship between the flat panel and the video display.

Turning now to the drawings and referring initially to FIGS. 1 and 2, a video-based hybrid slot machine 10 comprises a video display 12 and a generally flat panel 14 mounted over the video display 12. In the illustrated embodiment, the slot machine 10 is an "upright" version in which the video display 12 is oriented vertically relative to the player. Alternatively, the slot machine 10 may be a "slant-top" version in which the video display 12 is slanted at about a thirty-degree angle toward the player of the slot machine 10. The video display 12 may be a CRT, LCD, dot matrix, LED, electro-luminescent, or other type of video display known in the art.

The video display 12 is operable to depict a plurality of symbol-bearing, animated reels 16, 18, and 20. In response to a wager, the animated reels are rotated and stopped to randomly place symbols on the reels in visual association with at least one pay line 22. If a combination of symbols along the pay line 22 represents a winning combination, the player is awarded a payout identified on a pay table for that winning combination. The flat panel 14 is selectively transmissive to reveal the video reels 16, 18, and 20, credit meters 24, 26, and 28, and coin denomination 29 shown on the video display 12. Alternatively, instead of showing the credit meters 24, 26, and 28 and the coin denomination 29 on the video display 12, these items may be shown on miniature seven-segment LED displays mounted between the flat panel 14 and the underlying video display 12. Such LED displays are often employed in mechanical slot machines and, therefore, may assist in making the hybrid slot machine 10 appear like a mechanical slot machine.

The slot machine 10 includes a plurality of push-buttons on a button panel 30 for operating the slot machine. In addition, a touch screen may be mounted by adhesive, tape, or the like over a front surface of the flat panel 14. The touch screen contains soft touch keys denoted by graphics on the underlying flat panel 14 and/or video display 12 and used to operate the slot machine 10. The touch keys may be used to implement the same functions as the push-buttons, as well as additional functions depending upon the level of player interaction demanded by the slot game. A player can then enable a desired function either by touching the touch screen at an appropriate touch key or by pressing an appropriate push-button on the button panel 30.

In addition to a touch screen over the flat panel 14, another touch screen may be mounted over a front surface of the video display 12. The touch screen contains soft touch keys denoted by graphics on the underlying video display 12 and used by service or maintenance personnel to access and perform diagnostics/tests on the slot machine. The flat panel 14 is mounted to a door of the slot machine, while the video display 12 is mounted inside the slot machine cabinet. When the door is closed, the flat panel 14 covers the video display 12 such that any touch screen over the video display 12 is inaccessible. Therefore, to operate the touch screen over the video display 12 for the purpose of performing diagnostics/tests on the slot machine, the door is opened to move the flat panel 14 out of the way and provide access to the touch screen over the video display 12.

Figure 3:
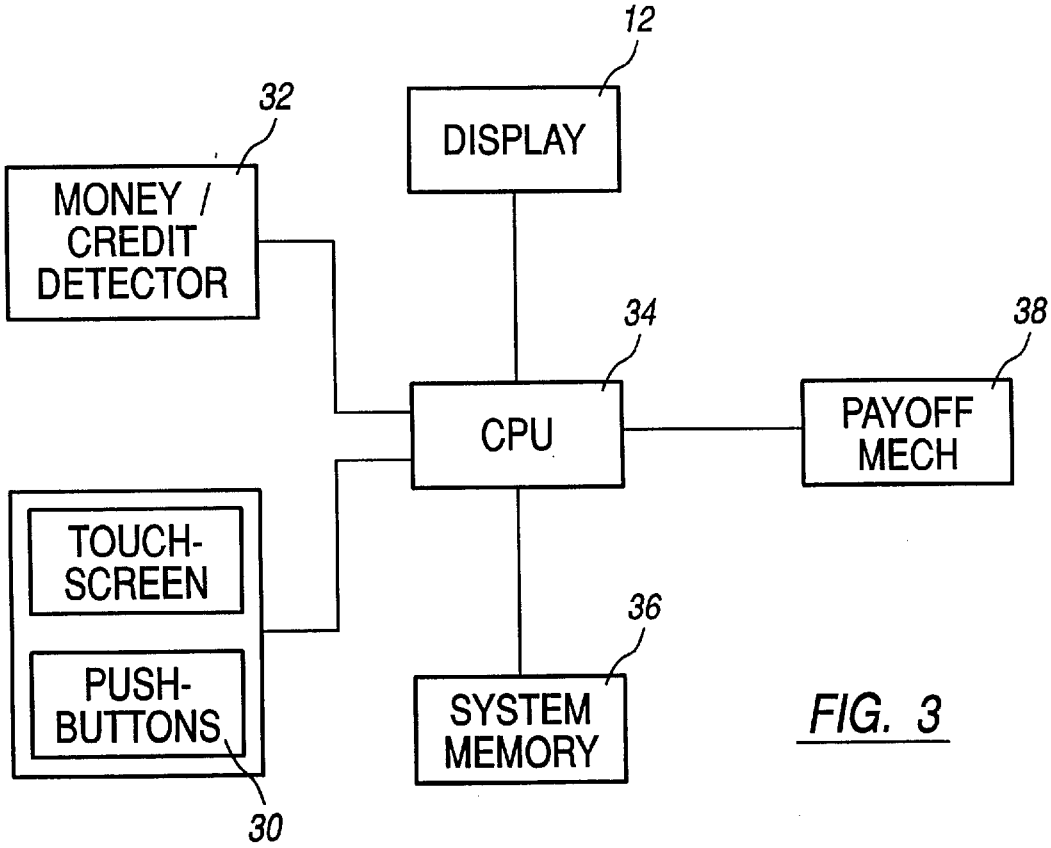
FIG. 3 is a block diagram of a control system suitable for operating the hybrid slot machine.

FIG. 3 is a block diagram of a control system suitable for operating the gaming machine 10. Money/credit detector 32 signals a central processing unit (CPU) 34 when a player has inserted money or played a number of credits. The money may be provided by coins, bills, tickets, coupons, cards, etc. Then, the CPU 34 operates to execute a game program that causes the video display 12 to depict three animated symbol-bearing reels. The player may select an amount to wager and start game play via the push-buttons 30 or touch screen (if provided), causing the CPU 34 to set the reels in motion, randomly select a game outcome, and then stop the reels to display symbols corresponding to the pre-selected game outcome. In one embodiment, one of the basic game outcomes triggers a bonus game.

A system memory 36 stores control software, operational instructions and data associated with the gaming machine 10. In one embodiment, the system memory 36 comprises a separate read-only memory (ROM) and battery-backed random-access memory (RAM). However, it will be appreciated that the system memory 36 may be implemented on any of several alternative types of memory structures or may be implemented on a single memory structure. A payoff mechanism 38 is operable in response to instructions from the CPU 34 to award a payoff to the player in response to certain winning outcomes that might occur in the basic game or the bonus game. The payoff may be provided in the form of coins, bills, tickets, coupons, cards, etc. The payoff amounts are determined by one or more pay tables stored in the system memory 36.

Figure 4:
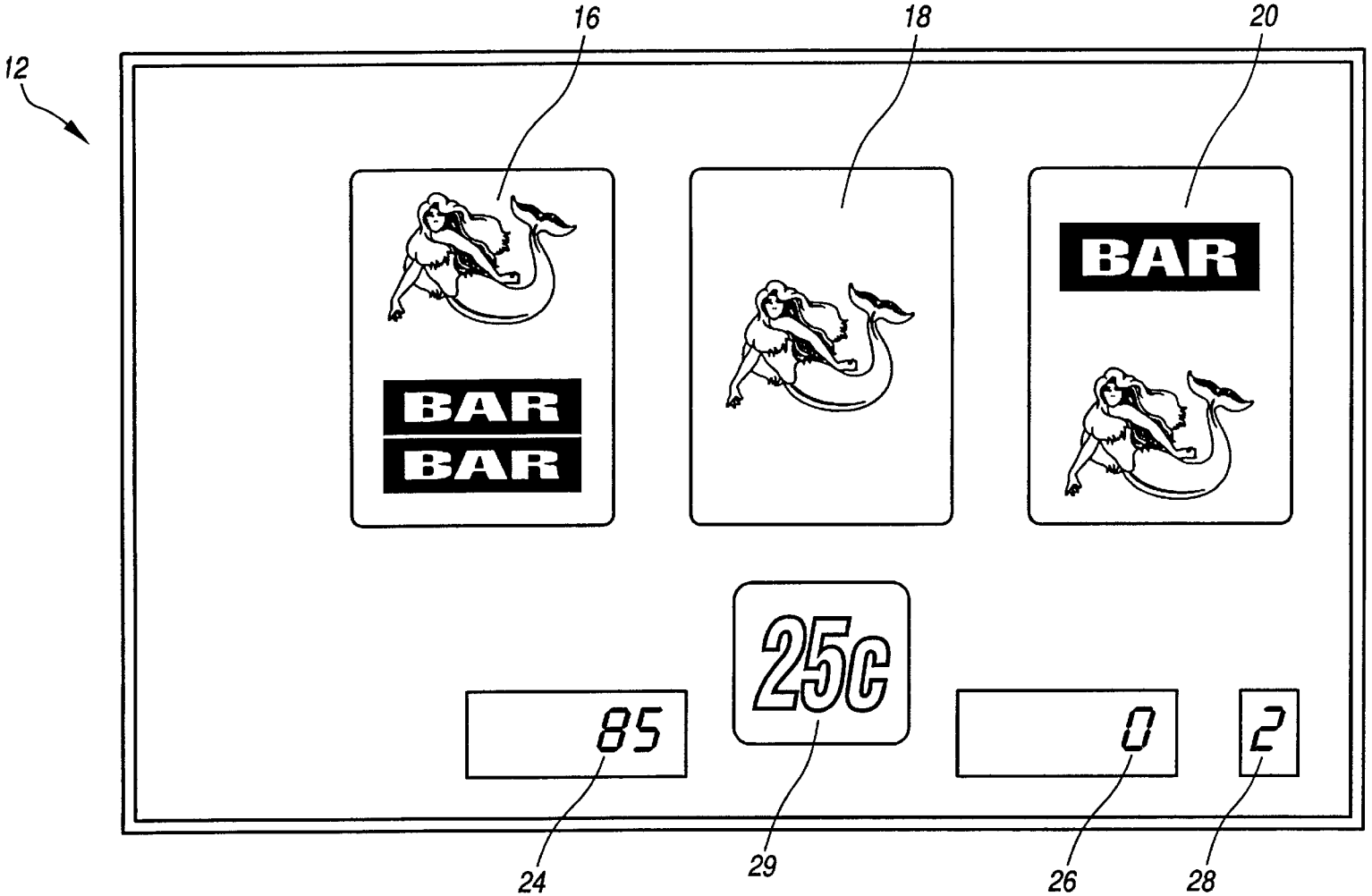
FIG. 4 is a front view of the video display by itself.

FIG. 4 is a front view of the video display 12 by itself, i.e., without the flat panel 14 mounted over it. The video display 12 depicts the plurality of animated reels 16, 18, and 20, the numbers on the credit meters 24, 26, and 28, and the coin denomination 29 (e.g., 25 cents). Although three animated reels are illustrated, the number of animated reels may be varied, for example, to include one or more additional reels. Also, instead of each column of symbols being associated with a single animated reel, each individual symbol may be associated with a single reel such that a 3×3 symbol array of nine symbols is associated with nine distinct animated reels.

Figure 5:
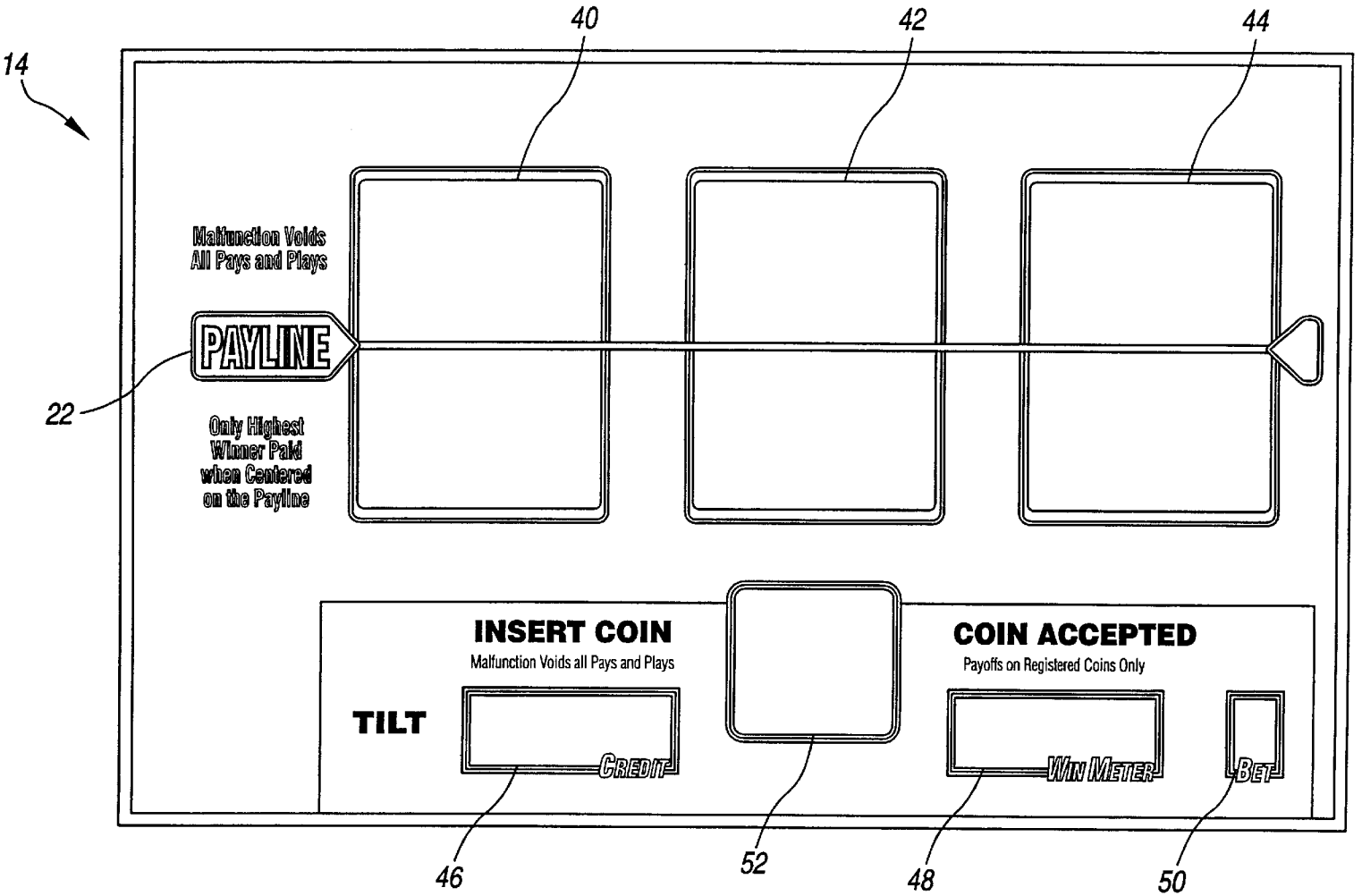
FIG. 5 is a front view of the flat panel by itself.

FIG. 5 is a front view of the flat panel 14 by itself, i.e., without the video display 12 behind it. The flat panel 14 is preferably composed of glass or plastic and is highly transmissive (i.e., transparent or translucent) of light in discrete areas to clearly reveal the video reels, credit meters, and coin denomination shown on the video display. Specifically, the flat panel 14 includes three large discrete transmissive windows 40, 42, and 44 for revealing the respective reels, three smaller discrete transmissive windows 46, 48, and 50 for revealing the respective credit meters, and a discrete transmissive window 52 for revealing coin denomination. By isolating and revealing the animated reels 16, 18, and 20 with the respective transmissive windows 40, 42, and 44 in the flat panel 14, the animated reels 16, 18, and 20 are made to appear like mechanical reels. The various discrete transmissive windows are preferably solid portions of the panel 14, but may alternatively be openings or apertures in the panel 14.

The remainder of the flat panel 14 is mostly non-transmissive, i.e., opaque, or substantially less transmissive than the discrete transmissive windows to emphasize graphics printed thereon and focus a player's attention toward the animated reels on the underlying video display. The graphics printed on the panel 14 show the pay line 22, miscellaneous textual information, instructions, trademarks, and credit meter labels. Some of these graphics (e.g., pay line 22, "TILT", "INSERT COIN" and "COIN ACCEPTED") are fairly transmissive and can be selectively highlighted with miniature lamps (e.g., light-emitting diodes) mounted to a backside of the flat panel 14 inside of a plastic or metal shadowbox. If necessary, the distance between the flat panel 14 and the underlying video display 12 may be increased to accommodate such lamps or other devices that may be placed between the panel 14 and the display 12. Alternatively, graphics may be highlighted by brightening portions of the video display 12 underlying the graphics. If there is more than one pay line, the pay lines may be successively highlighted as they are activated.

The flat panel 14 may utilize a number of different technologies to vary the optical transmissivity of different portions of the panel 14. In a preferred embodiment, the panel 14 is permanently imprinted with non-transmissive or low transmissive material encompassing and forming the various transmissive windows using a digital imaging or screen printing process. In one alternative embodiment, the panel 14 itself is a transmissive liquid crystal display (LCD) of the type commercially available from LG. Phillips LCD Co., Ltd. of Seoul, Korea. In another alternative embodiment, the panel 14 is a suspended particle device (SPD) of the type commercially available from Research Frontiers, Inc. A suspended particle device uses either a liquid suspension or a film within which droplets of liquid suspension are distributed. Light-absorbing microscopic particles are dispersed within the liquid suspension. The liquid suspension or film is then enclosed between two glass or plastic plates coated with a transparent conductive material. When an electrical voltage is applied to the suspension via the coatings, the particles are forced to align. This allows a range of transparency where light transmission can be rapidly varied to any degree desired depending upon the voltage applied. In a further alternative embodiment, the panel 14 includes polarizing layers in those areas where variation in optical transmissivity is desired.

Figure 6:
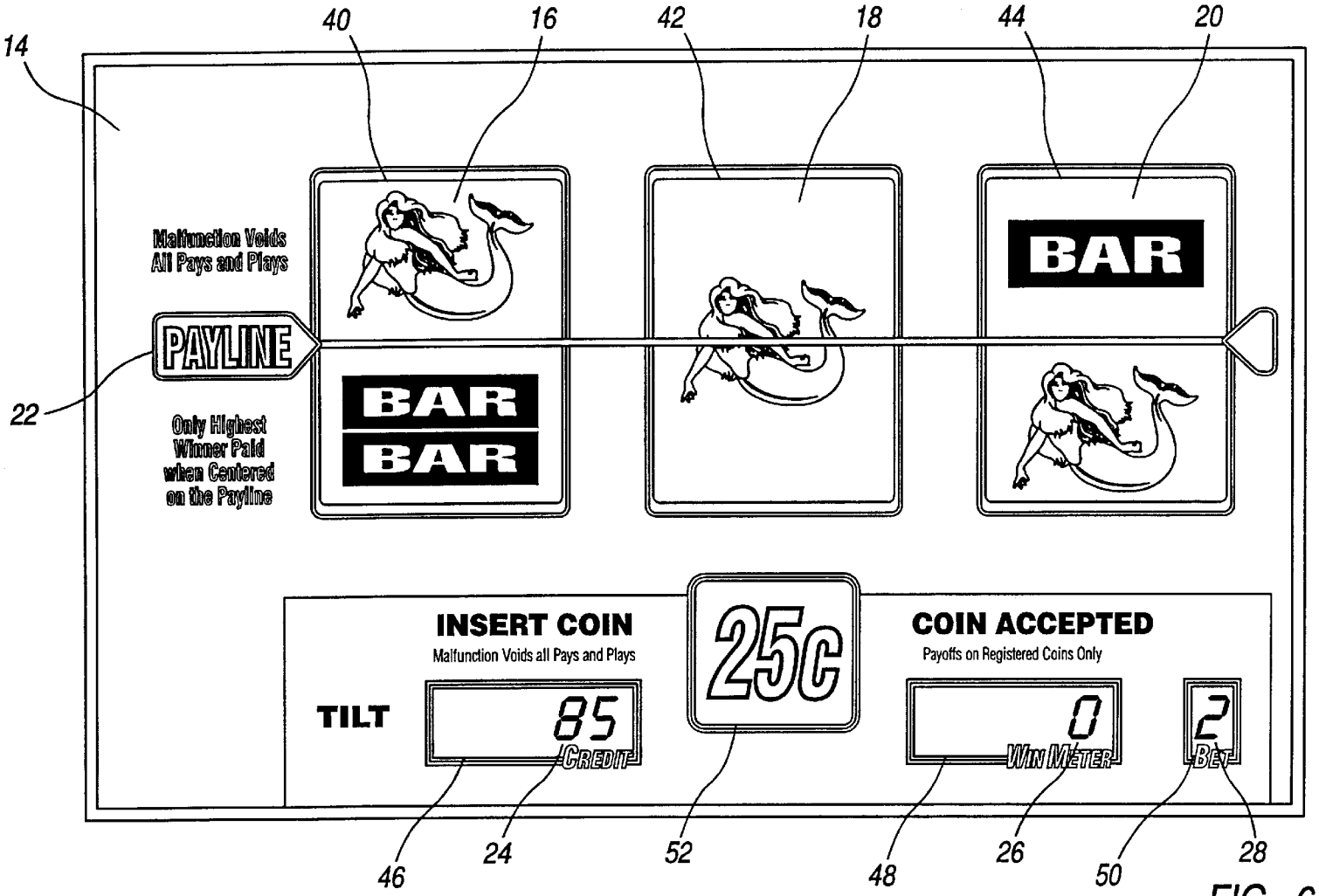
FIG. 6 is a front view of the flat panel mounted over the video display with the video display depicting a basic slot game.

FIG. 6 is a front view of the flat panel 14 mounted over the video display 12 with the video display 12 depicting a basic slot game. The discrete transmissive windows 40, 42, and 44 on the flat panel 14 reveal the respective animated reels 16, 18, and 20 on the video display 12. The horizontal pay line 22 on the flat panel 14 extents through a middle symbol on each of the reels. Although only the single pay line 22 is illustrated, the number of pay lines may be increased and may have various configurations other than a straight horizontal line. The discrete transmissive windows 46, 48, and 50 on the flat panel 14 reveal the respective credit meters 24, 26, and 28 on the video display 12. The discrete transmissive window 52 on the flat panel 14 reveals the coin denomination 29 (e.g., 25 cents) on the video display 12. As noted above, instead of showing the credit meters 24, 26, and 28 and the coin denomination 29 on the video display 12, these items may be shown on miniature seven-segment LED displays mounted behind the appropriate transmissive windows of the flat panel 14.

Referring to FIGS. 1 and 6, to play the basic slot game, a player inserts money provided by coins, bills, tickets, coupons, cards, etc. The "credit" meter 24 depicts a number of credits corresponding to the amount of inserted money. The player then chooses a number of credits to wager by pressing a "Bet" or "Max Bet" push-button on the button panel 30. The "bet" meter 28 depicts the number of credits wagered for the most recent play of the slot machine. After placing a wager, the animated reels 16, 18, and 20 may be set in motion by pressing a "Spin Reels" push-button or pulling the handle 32. The CPU uses a random number generator to select a basic game outcome corresponding to a particular set of reel "stop positions." The CPU then causes each of the animated reels to stop at the appropriate stop position. The reel symbols graphically illustrate the reel stop positions and indicate whether the stop positions of the reels represent a winning outcome.

Winning outcomes (e.g., symbol combinations resulting in payment of coins or credits) are identifiable to the player by a pay table. The pay table is preferably printed on an upper or lower glass panel affixed to the slot machine cabinet. A winning outcome occurs when the symbols appearing on the stopped reels 16, 18, and 20 along the pay line 22 correspond to one of the winning combinations on the pay table. A winning combination, for example, could be three matching symbols along the pay line 22. If the displayed symbols stop in a winning combination, the CPU credits the player an amount corresponding to the award in the pay table for that combination and number of credits wagered. The "win" or "paid" meter 26 depicts the number of awarded credits. The player may collect an amount of money corresponding to any credits remaining on the "credit" meter 24 by pressing a "Collect" push-button on the button panel 30.

In one embodiment, some of the losing basic game outcomes are "near miss" outcomes. A "near miss" outcome occurs when a "winning" symbol combination is visible on the stopped reels but at least one of the symbols of the winning combination is not along the pay line 22 such that the symbol combination along the pay line 22 represents a losing outcome. The basic game outcome in FIG. 6 is a "near miss" outcome because the "winning" symbol combination of three MERMAID symbols is visible on the stopped reels but the MERMAID symbols on reels 16 and 20 are one position away from the pay line 22.

Figure 7:
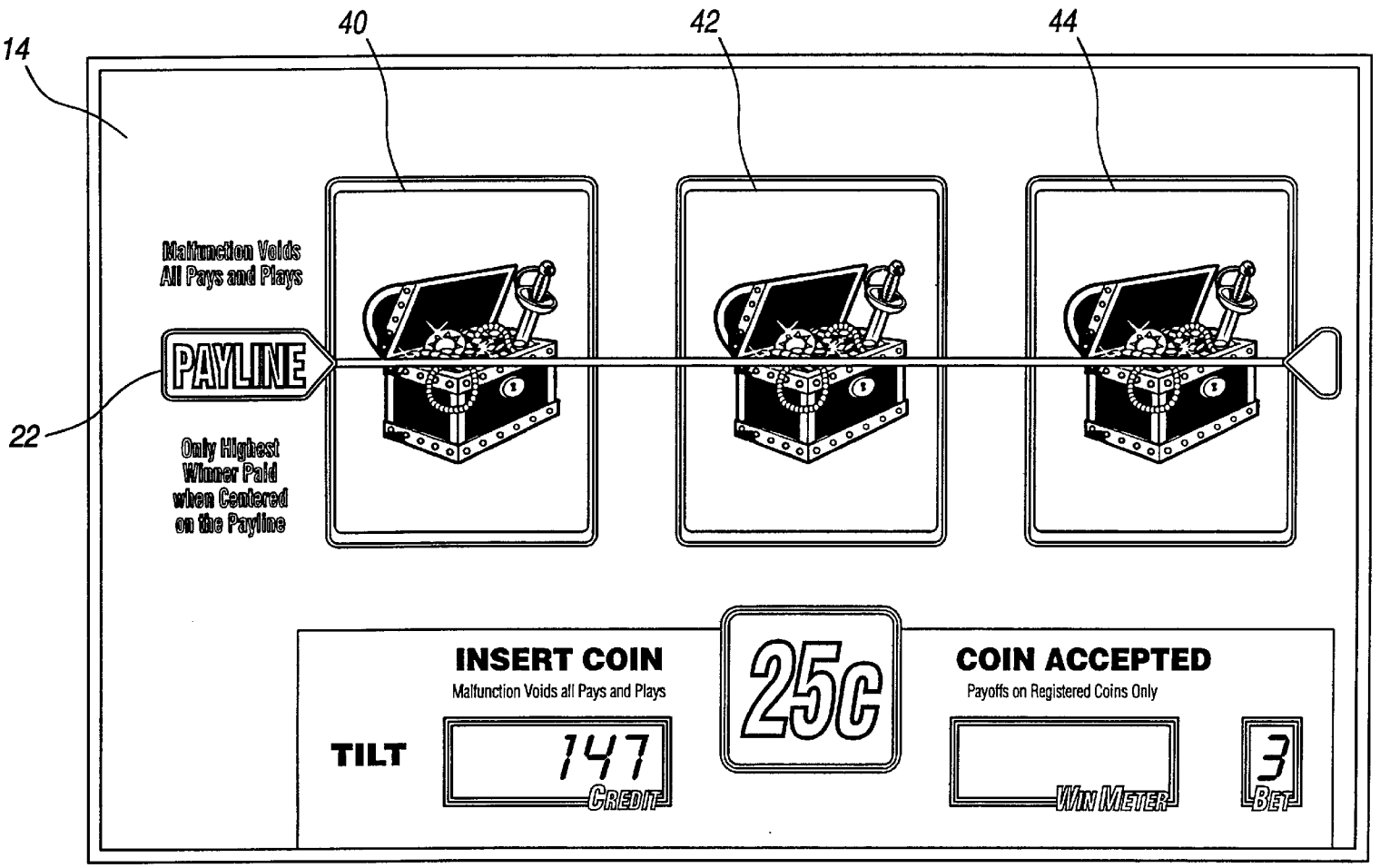
FIG. 7 is a front view of the flat panel mounted over the video display with the video display depicting a bonus game.

FIG. 7 is a front view of the flat panel 14 mounted over the video display 12 with the video display 12 depicting a bonus game. The bonus game is triggered by a start-bonus outcome in the basic slot game. The start-bonus outcome may, for example, be three MERMAID symbols along the pay line 22. Upon triggering the bonus game, the video display 12 no longer depicts the animated reels behind the respective transmissive windows 40, 42, and 44. Rather, treasure chests of gold, silver and bronze with random coin amounts appear behind the respective windows. The treasure chests then hinge close and swirl around. Using the push-buttons or touch screen (if provided), the player selects one of the treasure chests and is awarded the associated coin amount. Upon completion of the bonus game, the CPU shifts operation back to the basic slot game. In an alternative embodiment, the video display 12 is dedicated to the basic slot game, and the bonus game is depicted on a separate video display mounted in the slot machine cabinet above the main display 12.

The hybrid slot machine 10 offers a number of advantages. First, the video-based hybrid slot machine 10 looks like a mechanical slot machine and, therefore, would appeal to players of mechanical slot machines. As a result, the hybrid slot machine 10 would act as a steppingstone from mechanical to video-based slot machines. Second, the hybrid slot machine 10 can offer games that are difficult or impossible to implement on mechanical slot machines. For example, the video display 12 can depict first and second screen bonuses using animation that cannot be done on mechanical slot machines. Such bonuses can be interactive or non-interactive. Third, the hybrid slot machine 10 facilitates modifications to the existing game or conversions to new games. For example, to modify a game to accept a different coin denomination as a minimum wager (e.g., 5 cent, 25 cent, $1, $2, and $5), it is preferable to modify the theoretical payback percentage of the game. This is easily done without additional equipment by modifying the math tables in system memory and the distribution of reel symbols on the animated reels 16, 18, and 20. If the slot machine 10 had mechanical reels, one would need to change the mechanical reels or at least the physical reel strips to reflect the modified payback percentage. The new coin denomination is easily shown in the transmissive window 52 of the flat panel 14.

While the present invention has been described with reference to one or more particular embodiments, those skilled in the art will recognize that many changes may be made thereto without departing from the spirit and scope of the present invention. For example, instead of the three transmissive windows 40, 42, and 44 revealing the respective animated reels 16, 18, and 20, the three windows may be combined to form a single extra large window. This is done by eliminating the non-transmissive areas of the flat panel 14 between the windows 40 and 42 and between the windows 42 and 44. During the basic slot game, the portions of the video display 12 between the reels 16 and 18 and between the reels 18 and 20 are darkened to effectively isolate the three reels from each other and make them appear like mechanical reels. During the bonus game, the extra large window in the flat panel 14 allows for a greater portion of the video display 12 to be utilized for depicting bonus game graphics. Each of these embodiments and obvious variations thereof is contemplated as falling within the spirit and scope of the claimed invention, which is set forth in the following claims.

What is claimed is:

1. A method of conducting a wagering game on a gaming machine, the gaming machine including a video display and a panel mounted over the video display, the panel forming a plurality of windows, the panel bearing game-related information, the method comprising:

receiving a wager to play the wagering game;

displaying a basic game image associated with a basic game, the basic game image including a plurality of rotating, symbol-bearing reels, the windows overlying and revealing the respective reels, the panel masking portions of the basic game image encompassing the reels; and in response to a start-bonus outcome in the basic game, displaying a bonus game image associated with a bonus game, the bonus game image including bonus game indicia that does not include the reels, the same windows revealing the bonus game indicia.

2. The method of claim 1, wherein the bonus game indicia includes a plurality of selectable elements such that the bonus game is interactive, and further including receiving a selection from a player of at least one of the selectable elements.

3. The method of claim 1, wherein the basic game image includes a plurality of credit meters, the panel forming additional windows for revealing the credit meters.

4. The method of claim 1, wherein the game-related information includes at least one of a pay line, a credit meter label, and coin-related information.

5. A hybrid slot machine for conducting a wagering game, the wagering game including a basic game and a bonus game, the bonus game being triggered by a start-bonus outcome in the basic game, the machine comprising:

a video display for displaying a basic game image and a bonus game image, the basic game image including a plurality of rotating, symbol-bearing reels, the bonus game image including bonus game indicia that does not include the reels; and a panel mounted over the video display, the panel forming a plurality of windows, the panel bearing game-related information;

wherein during the basic game, the windows reveal the reels but the panel masks portions of the basic game image encompassing the reels;

wherein during the bonus game, the same windows reveal the bonus game indicia.

6. The machine of claim 5, wherein the bonus game indicia includes a plurality of player-selectable elements selectable by a player during the bonus game such that the bonus game is interactive.

7. The machine of claim 5, wherein the basic game image includes a plurality of credit meters, the panel forming additional windows for revealing the credit meters.

8. The machine of claim 5, wherein the game-related information includes at least one of a pay line, a credit meter label, and coin-related information.

9. The machine of claim 5, wherein the windows are respective solid portions of the panel.

10. The machine of claim 5, wherein the windows are respective openings in the panel.

* * * * *